US005406660A

United States Patent [19]

Johenning

[11] Patent Number: 5,406,660

[45] Date of Patent: Apr. 18, 1995

[54] WATERBED MATTRESS WITH PLASTIC NETTING FILL

[75] Inventor: John B. Johenning, Beverly Hills, Calif.

[73] Assignee: Strata Flotation, Inc., Torrance, Calif.

[21] Appl. No.: 207,303

[22] Filed: Mar. 7, 1994

[51] Int. Cl.[6] ..... A47C 27/08

[52] U.S. Cl. ..... 5/451; 5/920; 5/921

[58] Field of Search ..... 5/451, 450, 452, 919, 5/920, 921

[56] References Cited

U.S. PATENT DOCUMENTS

| | | | |
|---|---|---|---|
| 3,663,973 | 5/1972 | Spence | 5/909 |
| 4,672,701 | 6/1987 | Kocsis | 5/450 |
| 5,075,913 | 12/1991 | Luchonok | 5/451 |

*Primary Examiner*—Alexander Grosz
*Attorney, Agent, or Firm*—Flehr, Hohbach, Test, Albritton, & Herbert

[57] ABSTRACT

Waterbed mattress having an enclosure for holding a body of water for buoyantly supporting a person resting on the mattress, and a body of crumpled plastic netting within the enclosure for reducing wave action in the water and providing additional support for a person resting on the mattress. The crumpled plastic netting is enclosed within a casing of plastic netting. In one disclosed embodiment, hydraulic cells are positioned toward the head and foot ends of the mattress, and the crumpled netting is positioned between the cells to provide additional lumbar support for a person resting on the mattress. In another embodiment, the crumpled netting extends throughout the entire lateral extent of the mattress.

11 Claims, 2 Drawing Sheets

WATERBED MATTRESS WITH PLASTIC NETTING FILL

This invention pertains generally to waterbeds and, more particularly, to a waterbed mattress having means for reducing wave action and/or providing a firmer degree of support than the buoyancy of the water.

Heretofore, there have been a number of attempts to eliminate, or at least reduce, the wave motion which some people find disturbing in waterbed mattresses. Early attempts involved the use of vertically extending baffles which were connected to the upper wall of the mattress and produced an undesirable pulling or tensioning of the sleeping surface.

More recently, mattresses with horizontally extending baffles which are free of connection to the top wall have been provided. Such baffles typically consist of one or more mats of fibrous material which float in the water and provide the mattress with a firmer feel in addition to reducing wave action. One problem with the fibers is that, unless tethered, they can shift about inside the mattress and may eventually bunch up toward one end or one side of the mattress. Also, water tends to hang up in the fibers, making it difficult to drain all of the water from the mattress. It is not uncommon for as much as a hundred pounds, or more, of water to remain in the fibers, making it difficult to move the mattress. Moreover, bacteria can attach to the fibers, giving rise to odor problems. One example of a waterbed mattress having an expanded fiber fill is found in U.S. Pat. No. 4,301,560.

It is in general an object of the invention to provide a new and improved waterbed mattress.

Another object of the invention is to provide a mattress of the above character which overcomes the limitations and disadvantages of mattresses heretofore provided.

These and other objects are achieved in accordance with the invention by providing a waterbed mattress having an enclosure for holding a body of water for buoyantly supporting a person resting on the mattress, and a body of crumpled plastic netting within the enclosure for reducing wave action in the water and providing additional support for a person resting on the mattress. The crumpled plastic netting is enclosed within a casing of plastic netting. In one disclosed embodiment, hydraulic cells are positioned toward the head and foot ends of the mattress, and the crumpled netting is positioned between the cells to provide additional lumbar support for a person resting on the mattress. In another embodiment, the crumpled netting extends throughout the entire lateral extent of the mattress.

Figure 1:
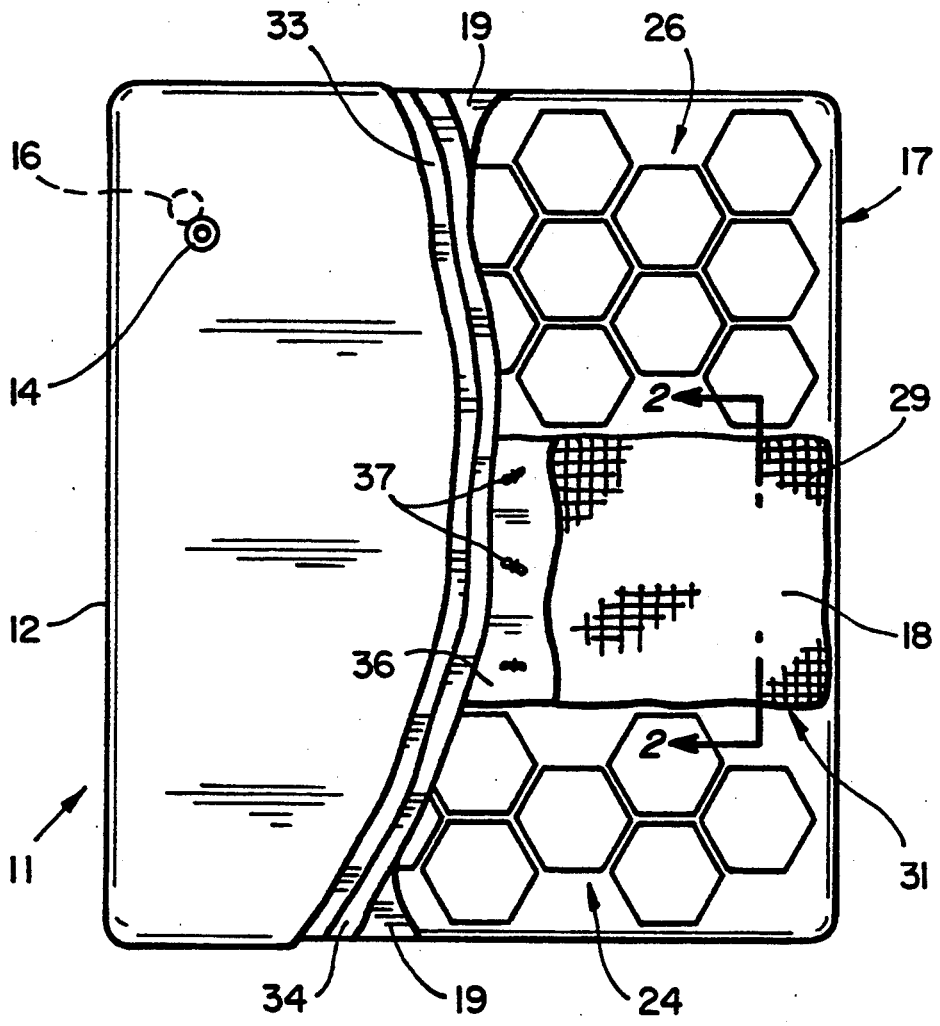
FIG. 1 is a top plan view, partly broken away, of one embodiment of a waterbed mattress incorporating the invention.
Figure 2:
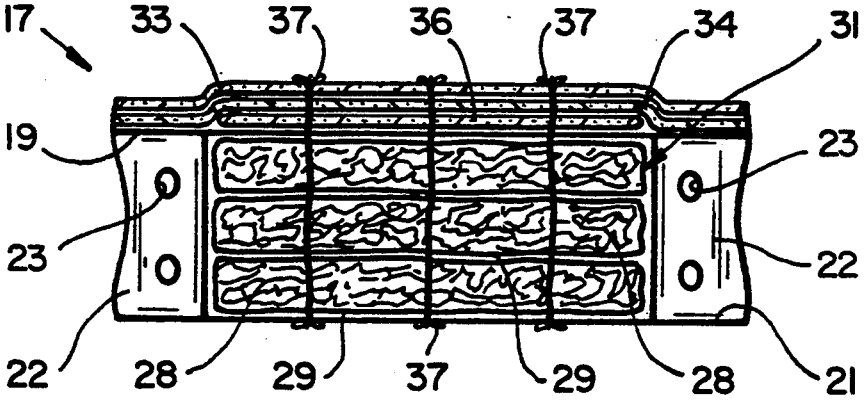
FIG. 2 is a fragmentary cross-sectional view taken along line 2—2 in FIG. 1.
Figure 3:
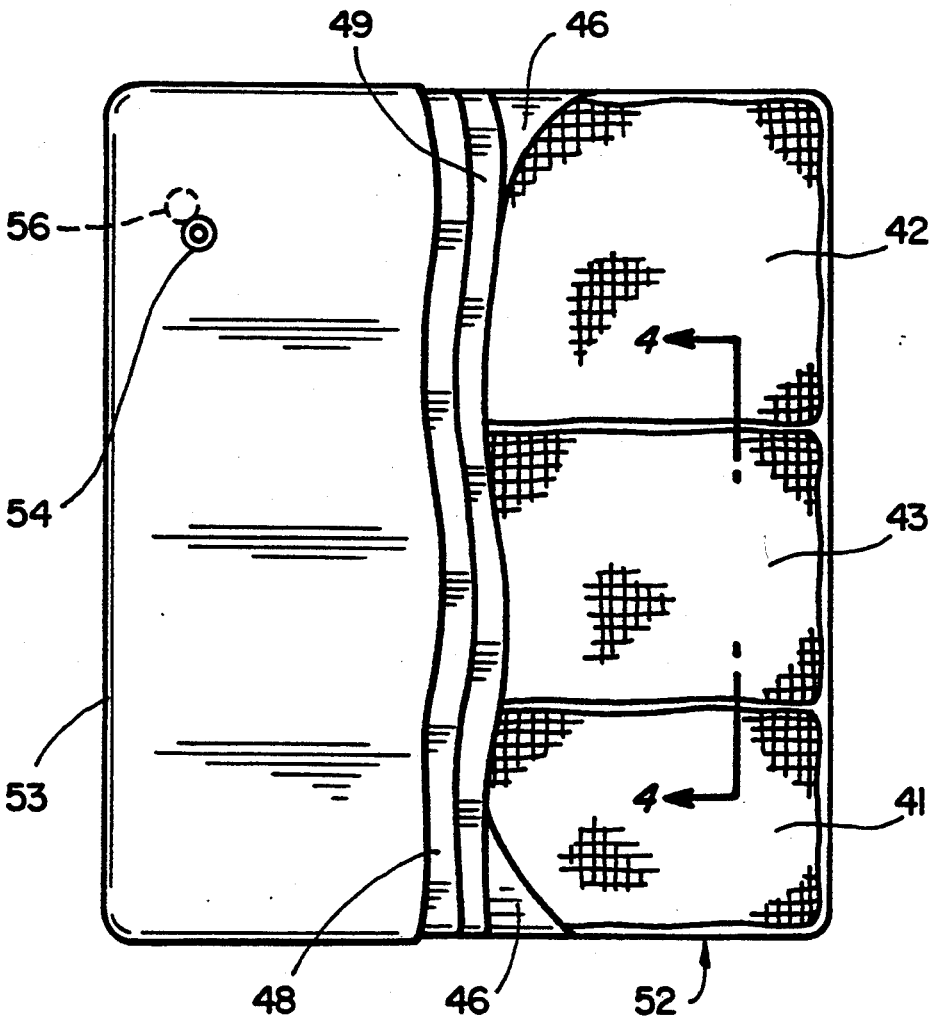
FIG. 3 is a top plan view, partly broken away, of another embodiment of a waterbed mattress incorporating the invention.

In the drawings, the invention is illustrated in connection with a waterbed mattress 11 having an enclosure 12 of water-impervious flexible material such as vinyl which contains a body of water. The water is introduced into the mattress through a fill valve 14 in the upper wall of the mattress and removed through a drain valve 16 in the lower wall.

In the embodiment of FIG. 1, the mattress has an insert 17 comprising a plurality of hydraulic cells in combination with a body of crumpled plastic netting 18 for reducing wave action in the water and providing additional lumbar support for a person resting on the mattress.

The insert has upper and lower sheets 19, 21 of flexible material such as vinyl which extend horizontally and are substantially coextensive with the upper and lower walls of the enclosure. The cells have side walls 22 which are sealed to the upper and lower sheets, with openings 23 in the side walls which permit water to flow into and out of the cells. In the embodiment illustrated, the cells are vertical cylinders, with a hexagonal shape in horizontal section. These cells are arranged in honeycomb arrays 24, 26 toward the head and foot ends of the bed, with three rows of cells at the head end and five rows at the foot end. An insert with cells of this type is described in greater detail in U.S. Pat. No. 5,172,437, along with a preferred method and apparatus for making the insert.

The plastic netting consists of relatively large sheets or strips of mesh 28 which are crumpled up and enclosed within envelopes or casings 29 to form pads 31. In the embodiment illustrated, three such pads are stacked vertically between sheets. 19, 21 in the region between the two groups of hydraulic cells. Each of the pads has a width approximately equal to the width of the mattress, a length on the order of 30 inches, and a thickness on the order of 3 inches.

The netting used as the fill material in one presently preferred embodiment is a relatively soft monofilament netting fabricated of extruded polypropylene with a strand diameter on the order of 12–17 mils and an opening diameter on the order of $\frac{1}{4}$–$\frac{1}{2}$ inch. Suitable nettings are available from Conwed Plastics, Minneapolis, Minn. under the designations ON 1558 and ON 5340. Such nettings have a tensile strength on the order of 30–60 pounds for a 3 inch strip. Other suitable materials for the netting include low density polyethylene (LDPE), high density polyethylene (HDPE), olefins and other man-made fibers.

The casings are also fabricated of a plastic mesh or netting. This netting is generally similar to the fill netting but in one presently preferred form has strands consisting of a large number (e.g., hundreds) of filaments or fibers woven together for greater tensile strength. The case netting can be the same type of material as the fill netting, e.g. polypropylene, LDPE, HDPE, olefins and other man-made fibers. Like the fill netting, it has mesh openings on the order of $\frac{1}{4}$–$\frac{1}{2}$ inch in diameter. Suitable case nettings are available from Tie Net International, Chicago, Ill. (Case Netting No. 288-35 RF) and from Maynard Plastics, Salem, Mass. (Case Netting No. 143-10). These nettings come in a tubular form and can be cut to length and closed together at the ends by heat sealing, stitching, sonic welding or other suitable means to form the enclosures. Instead of woven strands, the case netting can also be formed of an extruded material of suitable tensile strength.

The softness of the fill material and the amount of material placed in the casings determine the amount of resiliency and the firmness of the mattress. It has been found that a fill netting which supports a 40 to 70 pound load, which is 12 inches square, without compressing more than about one inch provides a mattress which is suitable for most people. However, stiffer or softer support can be provided by adding more or less of the fill material to the casings.

A pair of relatively thin foam pads 33, 34 overlie top sheet 19 and are laterally coextensive with that sheet. A smaller foam pad 36 is positioned on the upper side of top sheet 19 beneath the other foam pads and directly above the pads of crumpled netting. This pad has a lateral dimensions corresponding to those of the mesh pads and provides additional support in the lumbar region.

The foam pads are secured to the mesh pads, and the mesh pads are retained in position between the hydraulic cells by stitches or ties 37 which extend through the pads at laterally spaced intervals.

Figure 4:
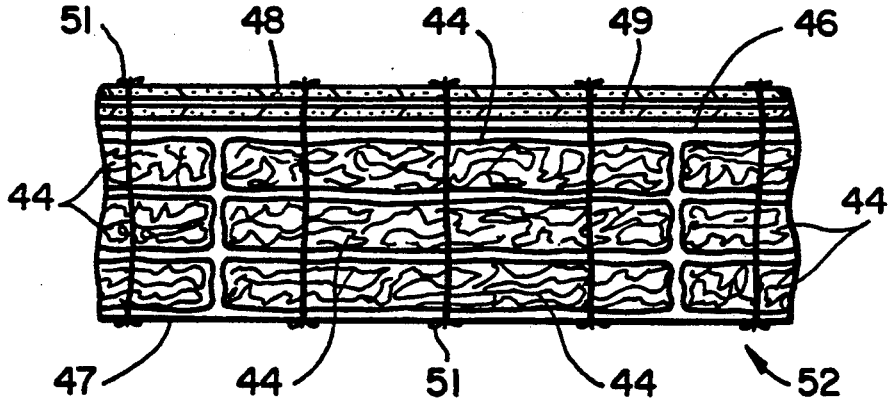
FIG. 4 is a cross-sectional view taken along line 4—4 in FIG. 3.

The embodiment of FIG. 4 differs from the embodiment of FIG. 1 in that the pads of crumpled netting extend throughout the entire lateral extent of the mattress, rather than having hydraulic cells-toward the head and foot ends. In this embodiment, a first set of mesh pads 41 is positioned toward the head end, a second set 42 is positioned toward the foot end, and a third set 43 is positioned in the middle between the other two sets. Each set consists of three vertically stacked pads 44 similar to pads 31, with each pad having a length approximately one-third the length of the mattress.

The mesh pads are positioned between upper and lower sheets 46, 47, with a pair of relatively thin foam pads 48, 49 on top of the upper sheet. The pads and sheets are held together by stitches or ties 51.

As in the embodiment of FIG. 1, the insert 52 formed by the pads and sheets is placed in an enclosure 53 of water-impervious flexible material to form a mattress. A fill valve 54 is provided in the top wall of the enclosure for introducing water into the mattress, and a drain valve 56 is provided in the bottom wall for removing the water.

The invention has a number of important features and advantages. It provides the same wave reduction as a fiber-filled mattress, but drains better and is easier to handle after draining. The drained weight of a kingsize mattress constructed in accordance with FIG. 1 is typically on the order of only about 30–40 pounds, whereas the drained weight of a fiber-filled mattress of the same size is on the order of 100 pounds. In addition, with the inert strands of the plastic netting, there is less tendency for the mattress to contract odors than there is with a mattress filled with conventional fibers.

It is apparent from the foregoing that a new and improved waterbed mattress has been provided. While only certain presently preferred embodiments have been described in detail, as will be apparent to those familiar with the art, certain changes and modifications can be made without departing from the scope of the invention as defined by the following claims.

I claim:

1. In a waterbed mattress: an enclosure for holding a body of water for buoyantly supporting a person resting on the mattress, hydraulic cells positioned within the enclosure toward head and foot ends of the mattress for reducing wave action in the water, and a body of crumpled plastic netting positioned within the enclosure between the cells for further reducing wave action and providing additional lumbar support for a person resting on the mattress.

2. The waterbed mattress of claim 1 wherein the plastic netting comprises a polypropylene mesh.

3. The waterbed mattress of claim 1 further including a casing of plastic netting enclosing the body of crumpled plastic netting.

4. In a waterbed mattress: an enclosure for holding a body of water for buoyantly supporting a person resting on the mattress, and crumpled plastic netting within the enclosure for reducing wave action in the water and providing additional support for a person resting on the mattress.

5. The waterbed mattress of claim 4 wherein the crumpled plastic netting extends throughout substantially the entire lateral extent of the mattress.

6. The waterbed mattress of claim 4 wherein the crumpled plastic netting is limited to a region of substantially lesser length than the mattress and located between head and foot ends of the mattress.

7. The waterbed mattress of claim 4 wherein the plastic netting comprises a mesh having strands on the order of 12–17 mils in diameter and openings on the order of $\frac{1}{4}$–$\frac{1}{2}$ inch in diameter.

8. The waterbed mattress of claim 4 wherein the plastic netting is fabricated of a material selected from the group consisting of polypropylene, low density polyethylene, high density polyethylene, other olefins and man-made fibers.

9. In a waterbed mattress: an enclosure for holding a body of water, a casing of plastic netting within the enclosure, and a body of crumpled plastic netting within the casing.

10. The waterbed mattress of claim 9 including additional bodies of crumpled plastic netting in casings of plastic positioned laterally adjacent to the first named body and casing.

11. The waterbed mattress of claim 9 wherein the plastic netting is fabricated of a material selected from the group consisting of polypropylene, low density polyethylene, high density polyethylene, other olefins and man-made fibers.

* * * * *